United States Patent [19]

Lau

[11] Patent Number: 4,767,081

[45] Date of Patent: Aug. 30, 1988

[54] CONVERSION OF MOTOR VEHICLE WHEELS

[76] Inventor: Boon W. Lau, 203 Henderson Industrial Park 0309, Singapore, Singapore, 0315

[21] Appl. No.: 921,094

[22] Filed: Oct. 21, 1986

[30] Foreign Application Priority Data

Oct. 30, 1985 [GB] United Kingdom ..... 8526755

[51] Int. Cl.[4] ..... B66D 3/00

[52] U.S. Cl. ..... 242/95

[58] Field of Search ..... 242/95, 865 R; 254/323; 180/7.5, 53.61

[56] References Cited

U.S. PATENT DOCUMENTS

| | | | |
|---|---|---|---|
| 3,292,905 | 12/1966 | McCain | 242/95 |
| 3,784,164 | 1/1974 | Blum | 242/95 |
| 3,820,734 | 6/1974 | Selliken | 242/95 |
| 3,917,228 | 11/1975 | Blum | 242/95 X |
| 4,261,621 | 4/1981 | Fox | 301/36 R |

FOREIGN PATENT DOCUMENTS

| | | |
|---|---|---|
| 244342 | 12/1925 | United Kingdom . |
| 508763 | 7/1939 | United Kingdom . |
| 539962 | 9/1941 | United Kingdom . |
| 621164 | 4/1949 | United Kingdom . |
| 644257 | 10/1950 | United Kingdom . |
| 990884 | 5/1965 | United Kingdom . |
| 2056924 | 3/1981 | United Kingdom . |
| 2145044 | 3/1985 | United Kingdom . |

*Primary Examiner*—David Werner

*Attorney, Agent, or Firm*—Jones, Tullar & Cooper

[57] ABSTRACT

Means for converting a vehicle wheel into e.g. a windlass comprise a kit of elongate members (1) screw-threadedly engageable in the wheel hub (5) in place of the normal wheel retainers (6). To form a windlass an end plate (16) may be attached to the members (1) using the retainers (6) such that the members (1) define the drum of the windlass. Alternatively each member may have an individual end flange to obviate the plate (16). Alternatively the members (1) may be used to attach a second wheel to the hub for extra traction.

3 Claims, 6 Drawing Sheets

27
28
29
30
31
31
31
31
32
33

CONVERSION OF MOTOR VEHICLE WHEELS

FIELD OF THE INVENTION

This invention relates to methods and means for the modification of one or more driving wheels of a motor vehicle by the addition of elements to them. In one example, a wheel is converted to act as a windlass; in another, to give additional traction by the addition of a further wheel.

BACKGROUND OF THE INVENTION

In most ordinary motor vehicles wheel discs are held to respective hubs by a number of screw-threaded connections arranged regularly angularly disposed about the axis of rotation of the wheel and hub.

These screw-threaded connections may be screw-threaded studs projecting from the hub, with nuts screwed down on them to entrap the disc, or may be bolts through the wheel screw-threadedly engaged in holes in the hub.

Proposals have been made in the past to use a vehicle's engine power to drive a windlass bolted to the hub. In these—see for example UK Patent Nos. 508763, 644257 and 1065690—a cylindrical winding drum is bolted to the wheel hub using the screw-threaded connections, generally with the wheel still in place. In each case the drum is a three-dimensionally bulky component with obviously limited applicability; it would be desirable to provide more convenient means for extending the functionality of a vehicle wheel.

SUMMARY OF THE INVENTION

Instead of a single bolt-on unit the present invention uses a plurality of separate elongate members which screw-threadedly engage the hub—holding the wheel disc if this is left in place—together providing means for retaining and/or defining a further functional part or parts.

Such elongate members may be bundled together compactly when not in use, and may be extremely versatile.

In one aspect of the invention a kit for forming a functional structure e.g. a windlass on a wheel hub comprises a plurality of separate elongate members with first ends that can be screwed to the wheel or wheel hub so that each member extends axially therefrom; that is, with a second end spaced from the wheel or hub. The second ends of the members offer further functionality.

In a preferred form the members have a male screw-thread at one end and a female screw-thread (both of the same diameter and threading) at the other: then, the same members may be used whether the vehicle has a hub with studs or with apertures; and the normal screwing means of the wheel disc (nuts or bolts respectively) are shifted to engage the screw-threaded hub of the member remote from the hub and entrap the additional element on them. The members may have a body which is a hexagonal column, that is in section the same as a hexagon nut or bolt-head, so that it may be driven by a spanner which fits also the normal screwing nuts or bolts of the wheel disc.

The kit may include an end member, preferably a circular dished plate, retainable on the second ends of the elongate members to define with the wheel or hub the end flanges of a windlass, the drum of the windlass to be defined by the cage of elongate members extending axially.

Alternatively or additionally, each elongate member may have a radially enlarged end e.g. a circular radial flange, so that the members can form a windlass without need for a separate end member.

A further possibility is for the end member to be an additional vehicle wheel, so that a double wheel assembly may be formed for e.g. extra traction.

In another aspect the invention provides a method of extending the functionality of a vehicle wheel and/or wheel hub by screwing thereto a plurality of elongate members of the type described, and as appropriate attaching a line and optionally an end member to one or more of the members to form a windlass, or an additional wheel to form a double wheel assembly.

In particular preferred methods, using elongate members having matching male and female threads at opposite ends, threaded nuts or bolts normally used to retain the wheel are removed, the members screwed on in their stead, and the removed nuts or bolts used to secure further members to the projecting ends of the elongate members.

It can be seen that the conversion of a wheel into a windlass can easily be done, so that the power of the motor vehicle may be applied to the line for lifting, haulage or any other purpose. When the vehicle is on a road or surface in the normal way, it will be necessary to jack it up to free the wheel for revolution for that purpose; but an important use envisaged is the rescuing of the vehicle itself from a position where it is stuck or even overturned. The wheel is converted into a windlass, a line from the windlass attached to an anchor such as a tree or pole, and the vehicle may extricate or right itself by driving the converted wheel in rotation.

BRIEF DESCRIPTION OF THE DRAWINGS

Particular embodiments of the invention will now be described with reference to the accompanying drawings, wherein.

DETAILED DESCRIPTION

Figure 1:
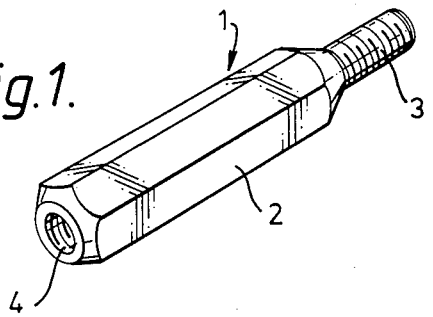
FIG. 1 is a perspective view of a conversion member.

FIG. 1 shows a conversion member 1 having a hexagonal-section body 2 with a male screw-threaded projecting portion 3 at one end and a female screw-threaded portion 4 at the other. It is made of strong metal such as high-tensile steel. The diameters and threadings of the two portions 3, 4 are the same, and the cross-sectional dimensions of the hexagon nut or bolts used for securing the wheels of motor vehicles. The transition between the body 2 and the portion 3 may be formed as a conventional centering cone (14, FIG. 2). The body 2 is axially elongate being for example 7.5 cm long at least—very substantially longer than the usual nuts or bolts used in this context.

FIG. 2 shows the members in use on a wheel hub 5 of the aperture type, where a wheel disc 13 is usually secured by bolts 6 screw-threadedly engaging apertures 7.

Figure 2A:
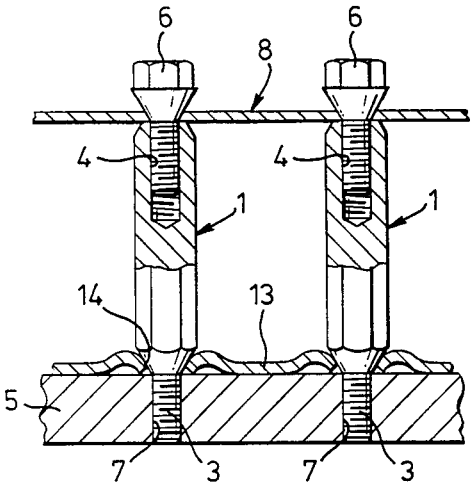
FIGS. 2*a* and 2*b* show in partial section a converted and normal wheel respectively of one type.
Figure 2B:
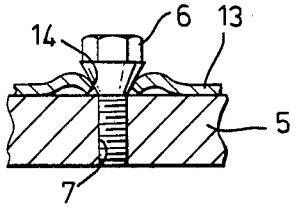

For converting this wheel the bolts 6 (FIG. 2*b*) are removed and the male portions 3 are screwed one by one into the vacated apertures 7 (FIG. 2*a*). When they are all positioned, there is an array of female portions 4 mimicking the disposition and size of the apertures 7. An end disc 8 may be secured to the ends of the members 1 remote from the wheel disc 13 by using the bolts 6. Previously, a looped end of a line may have been slipped over one of the members 1, as will be explained.

Figure 3A:
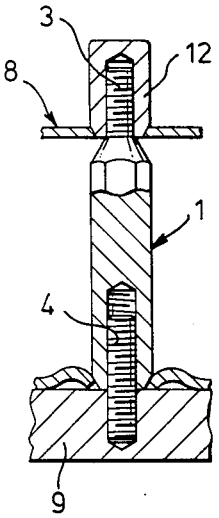
FIGS. 3*a* and 3*b* show in partial section a converted and normal wheel respectively of another type.
Figure 3B:
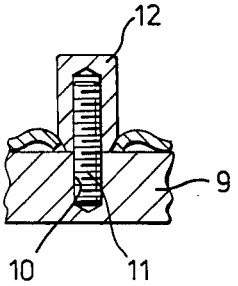

FIG. 3 shows how the same members 1 may be used for the conversion of a wheel where the hub 9 has screw-threaded projecting studs 11. A wheel disc 13 is usually secured by cap nuts 12 on these studs (FIG. 3*b*). For conversion these are removed and replaced one by one by members 1, this time with the portion 4 being screwed onto the stud 11. A disc 8 is secured to the remote ends by using the nuts 12 on the male portions 3 of the members 1.

Figure 4A:
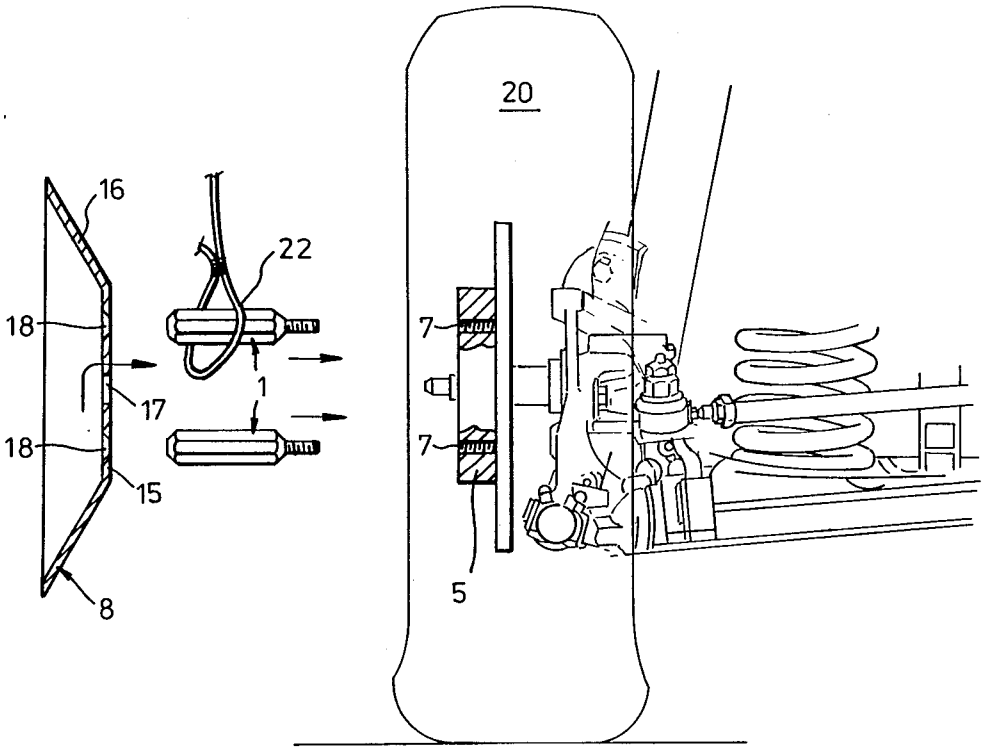
FIGS. 4*a* and 4*b* show stages in the conversion of a wheel on a motor vehicle.
Figure 4B:
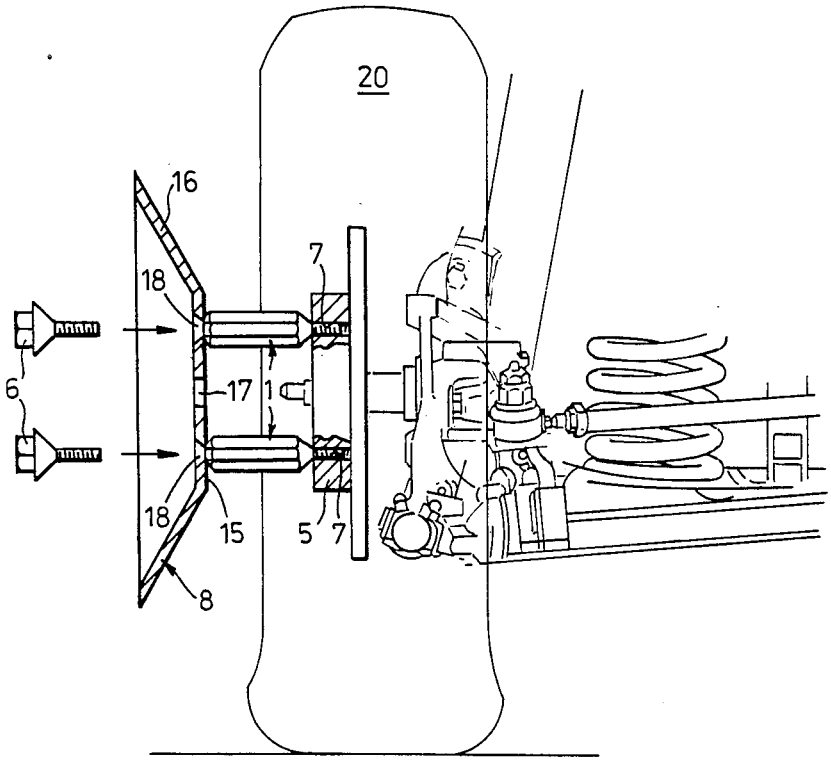

FIGS. 4*a* and 4*b* show, the sequence of assembly as described for FIG. 2 of the conversion onto a front wheel of a front-wheel-drive motor vehicle.

Figure 5:
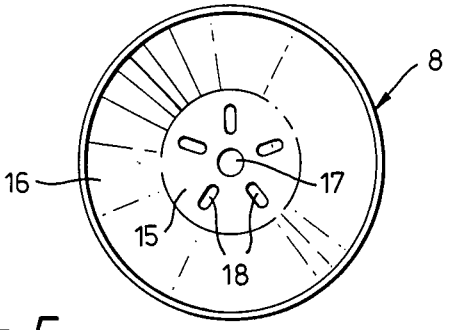
FIG. 5 is a face view of an integral end disc.

FIG. 5 is a face view of an end disc. Made of any suitable material (e.g. steel, aluminum, reinforced plastics), this has a planar central portion 15 surrounded by a frusto-conical dished part 16. Central aperture 17 has around it an array of apertures 18 each of which is a radially elongate slot and is for the reception of a bolt 6 (FIG. 2*a*) or male portion 3 (FIG. 3*a*).

Figure 6:
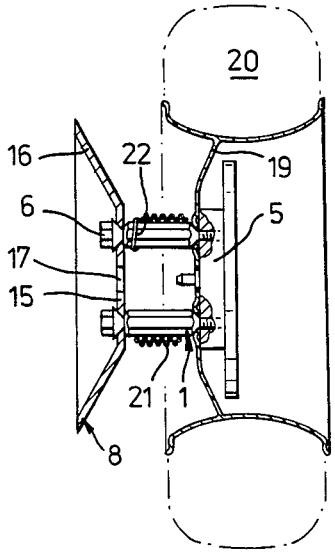
FIGS. 6 and 7 show in diametrical section and face view respectively a converted wheel in use as a windlass.
Figure 7:
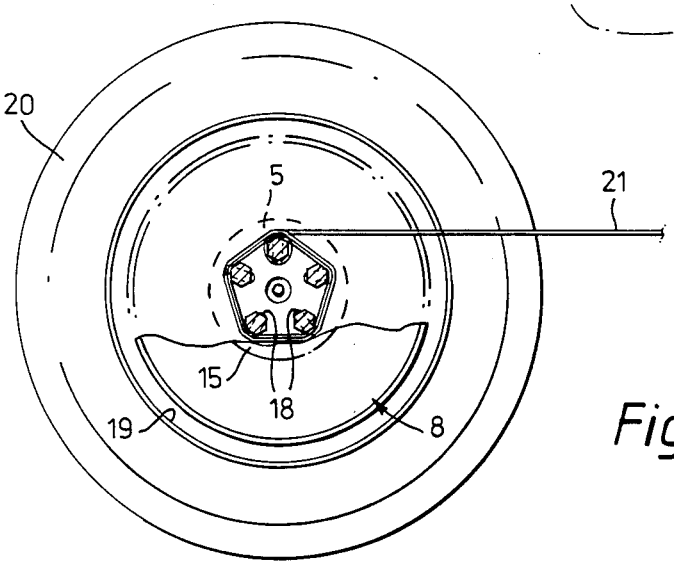

FIGS. 6 and 7 show the conversion of a wheel 20, which includes a conventional tire, to a windlass with a line 21 coiled onto the cage formed by the five bodies 2 of members 1, around one of which was passed during assembly a loop 22 at one end of the line. Of course, the line may be clipped or tied onto a member 1 after assembly. The wheel disc 13 and dished end disc 8 form the end flanges of the windlass of which the "drum" is the cage of bodies 2.

Rotation of the wheel by the usual engine drive of the vehicle will cause line 21 to be paid out or hauled in, so as to provide motive power to haul or lift objects or to move the vehicle itself.

Figure 8:
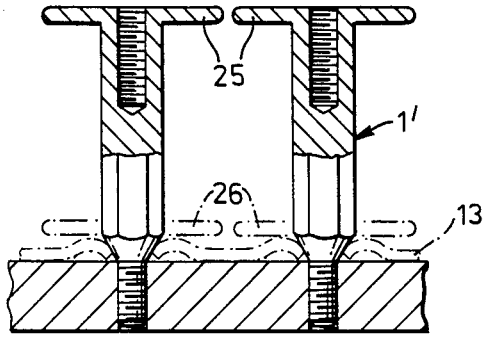
FIG. 8 shows in partial section a second form of conversion member.

FIG. 8 shows a modification. An end flange for a windlass need not be formed by an integral, additional, end disc such as 8 but by the total effect of an array of end flanges 25 on each of the members 1'. If end flanges 26 are provided also on the other ends of the bodies of the members 1', so that they are bobbin-like, the members may be used interchangeably on the wheel hub type of FIG. 2 (flanges 25 being outermost) or that of FIG. 3 (flanges 26 then being outermost).

Instead of an end flange disc such as 8 other elements may be secured to the wheel. One such is a second wheel (see FIG. 9) to provide additional traction in soft or wet places. The second wheel has holes disposed similarly to those on the first wheel disc 13. Nuts 12 or bolts 6 holding on the first wheel 13 are removed and elongate members 1 screwed on in their stead, as shown in the lower halves of FIGS. 2*a* or 3*a*. Then instead of an end disc 8, the holes of the additional wheel 31 are located on the projecting ends of the members 1 and the removed nuts 12 or bolts 6 are screwed on to secure the wheel 31 as the disc 8 is secured in the windlass example. A hollow cylindrical metal support tube (not shown) is preferably fitted around the elongate members, contacting the two wheel discs.

Figure 9:
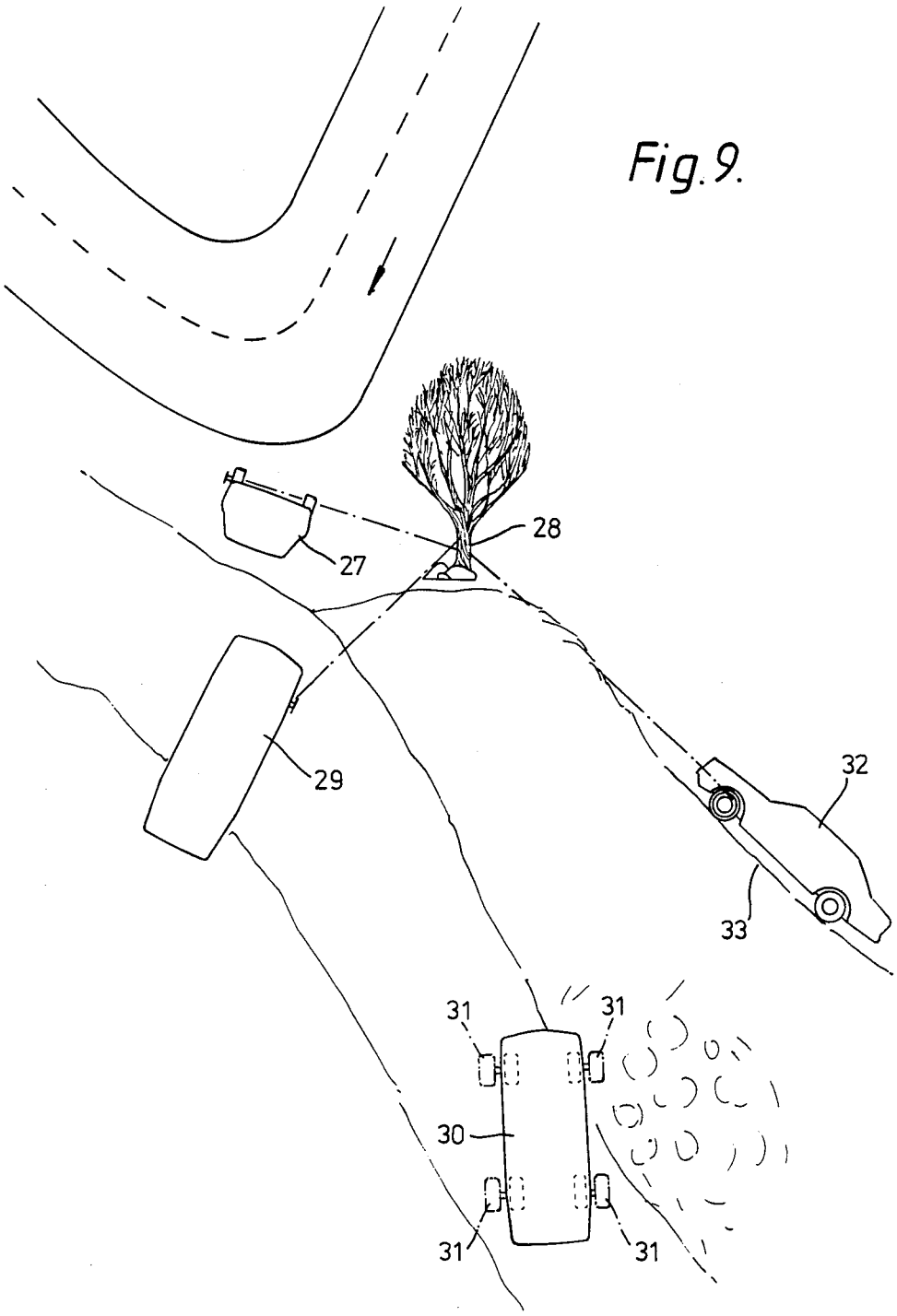
FIG. 9 shows how a converted vehicle wheel may be used in recovery of the vehicle itself.

FIG. 9 shows various ways in which the present invention may be used in vehicle recovery. This will be especially valuable in wild remote areas when help is not readily at hand, or for emergency or military vehicles. Car 27 has gone off the road and overturned. Provided its engine is still functional, by conversion of an appropriate one of its wheels to a windlass and securing its line to an anchor such as tree 28 the car may be righted. Car 29 has got stuck in a ravine; it may pull itself clear by conversion of a wheel to a windlass and attachment of the line to the convenient tree 28. Car 30 has become bogged down in soft ground. Conversion kits have enabled four (or it could be two) extra wheels 31 to be fitted to radically increase its ground-engaging wheel surface.

Car 32 is using a line from a converted wheel to pull itself up a steep slope 33.

By the addition to the basic conversion kit (an appropriate number of members 1, end disc, line and spanner) of one or more additional elements such as pulleys, couplings and the like for the line, the versatility of the conversion is greatly increased.

I claim:

1. A kit for adapting a motor vehicle wheel hub to wind a line, comprising:

a plurality of separate elongate members having first and second ends;

means on said first ends for screw-threadedly engaging the hub to space said second ends from the hub;

central portions of said elongate members between said first and second ends thereby forming a cage around which said line is to be wound; and each of said elongate members comprising at said second end an individual radially outwardly extending substantially circular flange for forming by said plurality of members an array of separate substantially circular flanges spaced from said hub and disposed about the axis thereof, for retaining wound line on said cage.

2. A kit according to claim 1 wherein each member further comprises a substantially circular radial flange at said first end whereby the member is bobbin-like, with a male screw thread at one of said first and second ends and a female screw thread at the other of said ends.

3. A kit according to claim 1 wherein said central portion of each said member is a hexagonal column.

* * * * *